US009179503B2

(12) United States Patent
Ishida et al.

(10) Patent No.: US 9,179,503 B2
(45) Date of Patent: Nov. 3, 2015

(54) METHOD FOR MANUFACTURING LIQUID EJECTION HEAD

(71) Applicant: CANON KABUSHIKI KAISHA, Tokyo (JP)

(72) Inventors: Yuzuru Ishida, Yokohama (JP); Takuya Hatsui, Tokyo (JP); Takeru Yasuda, Oita (JP)

(73) Assignee: Canon Kabushiki Kaisha, Tokyo (JP)

( * ) Notice: Subject to any disclaimer, the term of this patent is extended or adjusted under 35 U.S.C. 154(b) by 199 days.

(21) Appl. No.: 13/773,492

(22) Filed: Feb. 21, 2013

(65) Prior Publication Data

US 2013/0219702 A1 Aug. 29, 2013

(30) Foreign Application Priority Data

Feb. 24, 2012 (JP) ..... 2012-038859

(51) Int. Cl.

| | |
|---|---|
| ***H05B 3/26*** | (2006.01) |
| ***H05B 1/00*** | (2006.01) |
| ***B41J 2/14*** | (2006.01) |
| ***B41J 2/16*** | (2006.01) |

(52) U.S. Cl.

CPC ..... *H05B 1/00* (2013.01); *B41J 2/14129* (2013.01); *B41J 2/1603* (2013.01); *B41J 2/1628* (2013.01); *B41J 2/1629* (2013.01); *B41J 2/1631* (2013.01); *B41J 2/1639* (2013.01); *B41J 2/1642* (2013.01); *B41J 2/1643* (2013.01); *B41J 2/1646* (2013.01); *Y10T 29/49083* (2015.01)

(58) Field of Classification Search

CPC ..... H05B 1/00; Y10T 29/49083; B41J 2/16; B41J 2/14129; B41J 2/1603; B41J 2/1628; B41J 2/1629; B41J 2/1631; B41J 2/1639; B41J 2/1642; B41J 2/1643; B41J 2/1646

USPC ..... 29/592.1, 825, 890.1; 347/20, 64

See application file for complete search history.

(56) References Cited

U.S. PATENT DOCUMENTS

| | | | | |
|---|---|---|---|---|
| 5,485,185 | A * | 1/1996 | Sueoka et al. | 347/64 |
| 6,854,827 | B2 * | 2/2005 | Silverbrook | 347/29 |
| 6,880,920 | B2 * | 4/2005 | Murai | 347/70 |
| 2002/0123158 | A1 * | 9/2002 | Murai | 438/3 |
| 2011/0043565 | A1 * | 2/2011 | Sakuma et al. | 347/20 |

FOREIGN PATENT DOCUMENTS

| | | | |
|---|---|---|---|
| CN | 101734014 | A | 6/2010 |
| CN | 101945768 | A | 1/2011 |

(Continued)

*Primary Examiner* — Carl Arbes

(74) *Attorney, Agent, or Firm* — Canon U.S.A., Inc., IP Division

(57) ABSTRACT

A method for manufacturing a liquid ejection head includes the following processes in the following order: forming a first metal layer containing a first metal material on an insulating layer of a base on which a plurality of thermal energy generating elements and the insulating layer are laminated in this order; forming a second metal layer containing a second metal material on the first metal layer, and then patterning the second metal layer to form a plurality of protective portions; patterning the first metal layer to form a connection portion for electrically connecting the plurality of protective portions; inspecting the conduction of the connection portion and the plurality of energy generating elements; and patterning the connection portion to thereby electrically isolate the plurality of protective portions and form a plurality of close contact portions which are electrically isolated from each other.

13 Claims, 14 Drawing Sheets

(56) References Cited

FOREIGN PATENT DOCUMENTS

| | | | |
|---|---|---|---|
| JP | 2004-50646 | A | 2/2004 |
| JP | 2009-233939 | A | 10/2009 |
| JP | 2010-000632 | A | 1/2010 |
| JP | 2010-162870 | A | 7/2010 |
| JP | 2010-162876 | A | 7/2010 |

* cited by examiner

METHOD FOR MANUFACTURING LIQUID EJECTION HEAD

BACKGROUND OF THE INVENTION

1. Field of the Invention

The present invention relates to a method for manufacturing a liquid ejection head.

2. Description of the Related Art

A thermal type liquid ejection device causes film-boiling of liquid, such as ink, using thermal energy generated by energizing energy generating elements, and ejects the liquid from an ejection port utilizing pressure generated by the film-boiling to perform recording operation.

Such energy generating elements are covered with an insulating layer in order to secure the insulation between the elements and ink. Furthermore, a protective layer containing metal materials, such as tantalum and iridium, is provided in order to protect the energy generating elements from cavitation impact associated with disappearance of bubbles or chemical action caused by liquid. However, when the insulating layer has a hole (pinhole), electricity flows between the energy generating elements and the protective layer, which raises concern that desired heat generation properties are not obtained in recording operation and also the protective layer causes an electrochemical reaction, and thus deteriorates to reduce the durability or materials of the protective layer are eluted. Therefore, it is required to inspect the state of the protective layer in a manufacturing stage of a substrate for liquid ejection head to confirm that the energy generating elements and the protective layer are not conductive to each other.

Japanese Patent Laid-Open No. 2004-50646 discloses a method for inspecting insulation using an inspection terminal connected to a protective layer that is provided in the shape of a belt in such a manner as to protect a plurality of energy generating elements in common and an inspection terminal connected to the plurality of energy generating elements in common. According to the method, the plurality of energy generating elements can be collectively inspected for the insulation by an insulating layer.

However, in the configuration disclosed in Japanese Patent Laid-Open No. 2004-50646, the plurality of energy generating elements are covered with the protective layer which is continuous in the shape of a belt. Therefore, when the energy generating elements and the protective layer enter a conductive state even at one portion during recording operation, a current flows to the protective layer covering the other energy generating elements. As a result, the entire protective layer deteriorates, which raises a possibility that poor ejection occurs in all the energy generating elements, so that recording operation cannot be continued.

In order to prevent the problem such that poor ejection occurs in all the energy generating elements in a chain reaction manner, it is considered to provide protective layers in such a manner as to be electrically isolated and independent from each other for each energy generating element. However, in such a case, an inspection of confirming the insulation between the protective layers and the energy generating elements need to be performed for each energy generating element, which requires a huge number of inspection terminals and huge time for the inspection. Thus, the efficiency is not good.

SUMMARY OF THE INVENTION

The invention provides a method for manufacturing a substrate for liquid ejection head in which one energy generating element and a protective layer enters a conductive state, an electrochemical change of the protective layer caused by the conductive state is not transmitted to the other energy generating elements. The invention also provides a method for manufacturing a liquid ejection head in which the insulation between a protective layer and energy generating elements can be efficiently confirmed.

A method for manufacturing a liquid ejection head having a plurality of thermal energy generating elements which generate thermal energy to be utilized for ejecting liquid, an insulating layer covering the plurality of energy generating elements, a plurality of close contact portions provided on the insulating layer corresponding to the plurality of energy generating elements in one-to-one relationship, and a plurality of protective portions provided on the plurality of the close contact portions in one-to-one relationship, includes the following processes in the following order: a process of preparing a base on which the plurality of thermal energy generating elements and the insulating layer are laminated in this order; a process of forming a first metal layer containing a first metal material on the insulating layer of the base; a process of forming a second metal layer containing a second metal material on the first metal layer, and then patterning the second metal layer to form the plurality of protective portions containing the second metal material; a process of patterning the first metal layer to form a connection portion for electrically connecting the plurality of protective portions; a process of inspecting the conduction of the connection portion and the plurality of energy generating elements; and a process of patterning the connection portion to thereby electrically isolate the plurality of protective portions from each other and form the plurality of close contact portions which are electrically isolated from each other and contain the first metal material.

The invention can provide a method for manufacturing a liquid ejection head in which even when one of the energy generating elements and the protective layer enters a conductive state, poor ejection does not occur in all the energy generating elements, and the insulation between the protective layer and the energy generating elements can be efficiently confirmed.

Further features of the present invention will become apparent from the following description of exemplary embodiments with reference to the attached drawings.

DESCRIPTION OF THE EMBODIMENTS

Figure 1A:
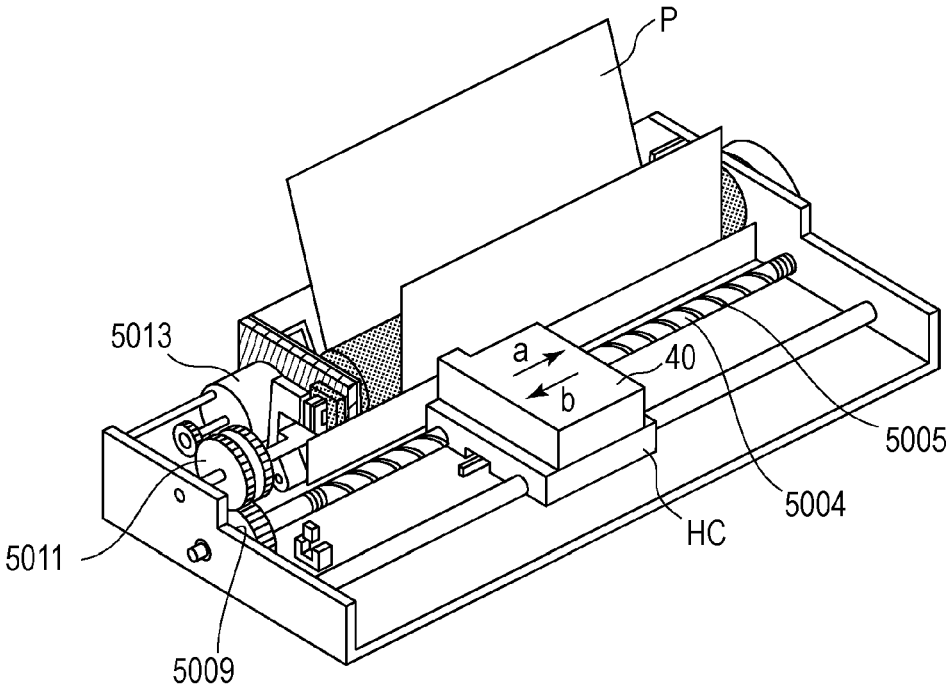
FIGS. 1A and 1B illustrate an example of a liquid ejection device and a liquid ejection head unit to which a liquid ejection head of the invention can be applied.

A liquid ejection head can be mounted on apparatuses, such as a printer, a copier, a facsimile machine having a communication system, and a word processor having a printer and further on industrial recording apparatuses combined with various processing apparatuses in a complex manner. The use of the liquid ejection head allows recording on various types of recording media, such as paper, thread, fiber, textile, leather, metal, plastic, glass, wood, and ceramic.

The term "recording" as used in this specification includes not only giving images having meanings, such as letters or figures, to target recording media but giving images not having meanings, such as patterns, thereto.

The "ink" should be broadly interpreted and refers to liquid that is given to target recording media, and thus is subjected to the formation of images, designs, patterns, and the like, processing of target recording media, or treatment of ink or target recording media. Herein, the treatment of ink or target recording media refers to an improvement of fixability due to solidification or insolubilization of coloring materials in ink to be applied to target recording media, an improvement of recording quality and color developability, an improvement of image durability, and the like.

Hereinafter, the embodiments of the invention are described with reference to the drawings. In the following description, the components having the same function are designated by the same reference numerals and the description therefor is omitted in some cases.

Liquid Ejection Device

FIG. 1A is a schematic view illustrating a liquid ejection device on which the liquid ejection head according to the invention can be mounted.

As illustrated in FIG. 1A, a lead screw 5004 rotates through driving force transmitting gears 5011 and 5009 in synchronization with regular and reversible rotation of a drive motor 5013. A carriage HC allows mounting of a head unit thereon and has a pin (not illustrated) which engages with a spiral groove 5005 of the lead screw 5004, so that the carriage HC is reciprocated in the directions indicated by the arrows "a" and "b" by the rotation of the lead screw 5004. On the carriage HC, a head unit 40 is mounted.

Head Unit

Figure 1B:
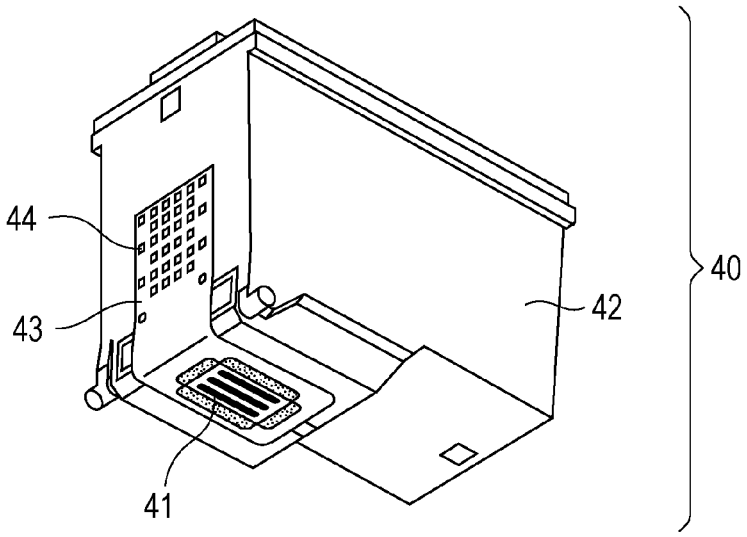

FIG. 1B is a perspective view of a head unit 40 which can be mounted on the liquid ejection device as illustrated in FIG. 1A. A liquid ejection head 41 (hereinafter also referred to as a "head") is conducting to a contact pad 44 to be connected to the liquid ejection device through a flexible film wiring board 43. The head 41 is joined to an ink tank 42 to be unified to thereby constitute the head unit 40. The head unit 40 illustrated herein as an example is one in which the ink tank 42 and the head 41 are unified but can also be a separate type in which the ink tank can be separated.

Liquid Ejection Head

Figure 2A:
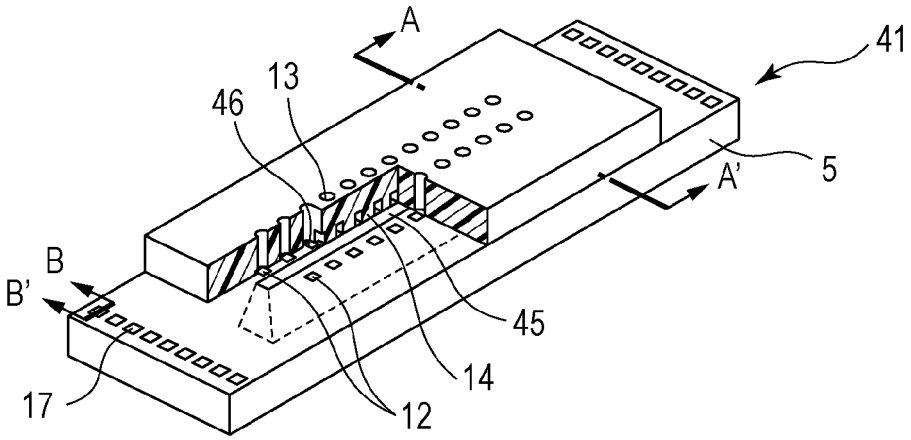
FIGS. 2A and 2B are a perspective view and a top view, respectively, of the liquid ejection head of the invention.
Figure 2B:
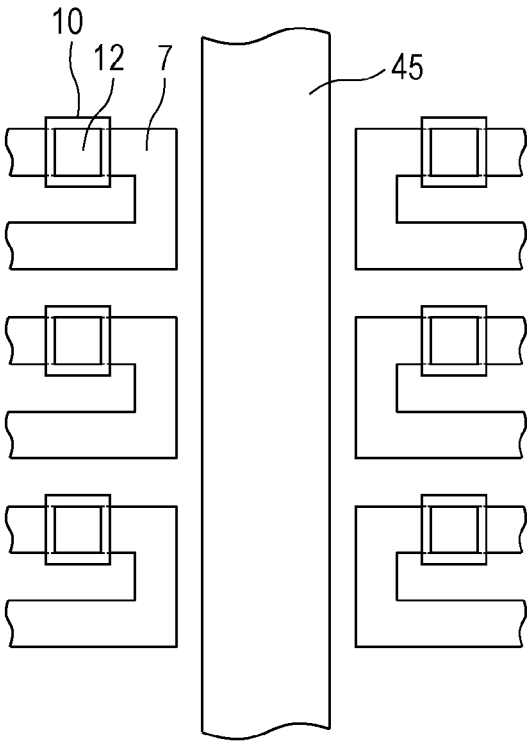
Figure 3A:
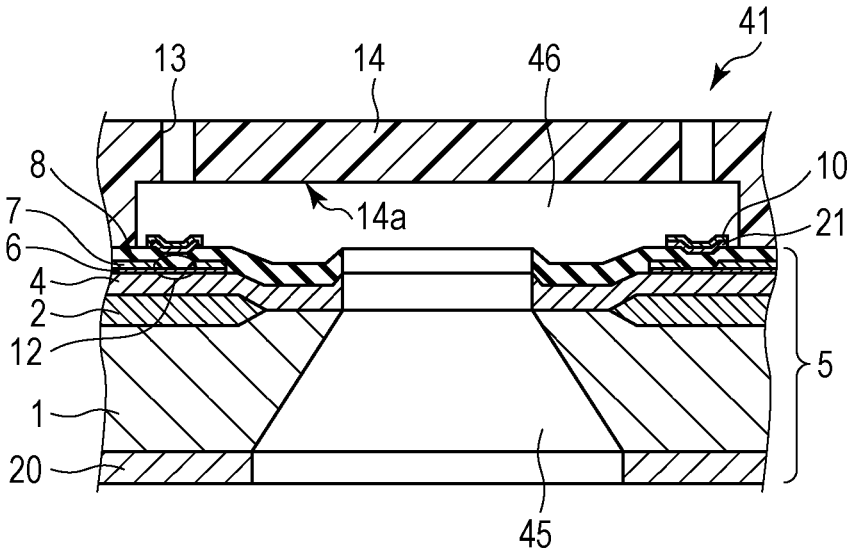
FIGS. 3A and 3B schematically illustrate cross sectional views of the liquid ejection head of the invention.
Figure 3B:
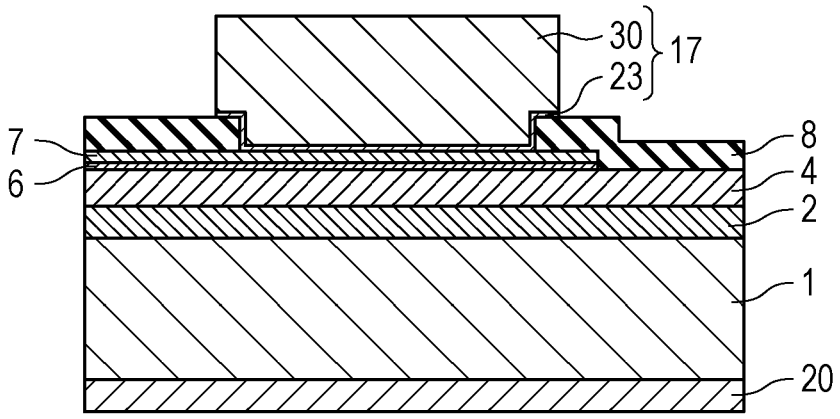

FIG. 2A illustrates a perspective view of the liquid ejection head 41 according to the invention. FIG. 2B is a top view schematically illustrating a portion of energy generating elements 12 of the liquid ejection head 41. FIG. 3A is a cross sectional view schematically illustrating the state of the cutting plane when the liquid ejection head 41 is cut perpendicularly to a substrate 5 along the A-A' line of FIG. 2A. FIG. 3B is a cross sectional view schematically illustrating the state of the cutting plane when a portion of a terminal 17 of the liquid ejection head 41 is cut perpendicularly to the substrate 5 along the B-B' line of FIG. 2A.

The liquid ejection head 41 is provided with a substrate for liquid ejection head 5 having the energy generating elements 12 which generate thermal energy to be utilized for ejecting liquid and a flow path wall member 14 provided on the substrate for liquid ejection head 5. The flow path wall member 14 can be formed with a cured substance of thermosetting resin, such as epoxy resin, and has ejection ports 13 for ejecting liquid and a wall 14*a* of a flow path 46 communicating with the ejection ports 13. Due to the fact that the flow path wall member 14 contacts the substrate for liquid ejection head 5 with the wall 14*a* at the inside, the flow path 46 is provided. The ejection ports 13 provided in the flow path wall member 14 are provided in such a manner as to form a line with a given pitch along a supply port 45. Liquid supplied from the supply port 45 is conveyed to the flow path 46, and the liquid undergoes film-boiling by the thermal energy generated from the energy generating elements 12, whereby bubbles are generated. The liquid is ejected from the ejection port 13 due to the pressure generated then, and thus recording operation is performed. The energy generating elements 12 are covered with protective layers 10 in order to protect the energy generating elements 12 from the influence of the cavitation caused when ejecting liquid. The liquid ejection head 41 further has the supply port 45 provided penetrating the substrate for liquid ejection head 5 in order to supply liquid to the flow path 46 and terminals 17 for electrically connecting the plurality of energy generating elements 12 to the outside, e.g., a liquid ejection device.

As illustrated in FIG. 3A, a thermal oxidation layer 2 that is provided by partially thermally oxidizing the base 1 and a heat storage layer 4 containing a silicon compound are provided on the base 1 containing silicon on which driving elements, such as a transistor, are provided. On the heat storage layer 4, a heat generation resistive layer 6 containing materials that generate heat by energization (e.g., TaSiN or WSiN) is provided and a pair of electrodes 7 containing aluminum whose resistance is lower than that of the heat generation resistive layer as the main component are provided in such a manner as to contact the heat generation resistive layer 6. By applying a voltage between the pair of electrodes 7 to energize a portion between the pair of electrodes 7 of the heat generation resistive layer 6 to generate heat, the portion of the heat generation resistive layer 6 is used as the energy generating element 12. The heat generation resistive layer 6 and the pair of electrodes 7 are covered with an insulating layer 8 containing insulating materials, such as a silicon compound, e.g., SiN, in order to achieve insulation from liquid, such as ink, to be ejected. Furthermore, in order to protect the energy generating elements 12 from the cavitation impact or the like caused by foaming and contraction of liquid for ejection, the protective layers 10 (protective portions) used as a cavitation resistive layer are provided on the insulating layer 8 corresponding to the portions of the energy generating elements 12. In order to secure the close contact between the insulating layer 8 and the protective layers 10, close contact layers 21 (close contact portions) are provided between the insulating layer 8 and the protective layers 10. The close contact layers 21 (plurality of close contact portions) are provided on the plurality of energy generating elements 12 in one-to-one relationship. As illustrated in FIGS. 2B and 3A, the protective layers 10 (plurality of protective portions) are provided corresponding to the plurality of energy generating element 12 in one-to-one relationship. More specifically, the protective layers 10 (plurality of protective portions) are provided on the close contact layers 21 (plurality of close contact portions) in one-to-one relationship.

Specifically, for the protective layers 10, metal materials, such as tantalum, iridium, and ruthenium, can be used. For the close contact layers 21, materials, such as titanium tungsten (TiW), can be used. Furthermore, the flow path wall member 14 is provided on the insulating layer 8. In order to increase the close contact between the insulating layer 8 and the flow path wall member 14, an close contact layer containing polyether amide resin or the like can also be provided between the insulating layer 8 and the flow path wall member 14. On the surface opposite to the surface on which the energy generating elements 12 are provided of the base 1, a thermal oxidation layer 20 used as a mask during an etching process for forming the supply port 45 is left behind.

The terminals 17 used for connection to the outside and driving of the energy generating elements 12 are formed by a diffusion preventing layer 23 containing materials, such as titanium tungsten (TiW), and a plating layer 30 containing gold or the like provided on an opening provided in the insulating layer 8 as illustrated in FIG. 3B.

As illustrated in FIG. 2B, the plurality of protective layers 10 (plurality of protective portions) are electrically isolated from each other for each energy generating element 12. By providing the protective layers 10 as described above, even when a hole is formed in the insulating layer 8 due to a certain factor during recording operation, a current merely flows only to the protective layer 10 covering one of the energy generating elements 12. When a current flows, an electrochemical reaction occurs. When tantalum is used as the protective layer 10, the protective layer 10 is oxidized. When iridium or ruthenium is used, a phenomenon in which the protective layer 10 dissolves occurs. In such a state, there is a possibility such that poor ejection occurs. However, by electrically isolating the protective layers 10, each covering each of the plurality of energy generating elements 12, from each other, a current does not flow to the other energy generating elements 12, so that the electrochemical reaction does not occur in a chain reaction manner. Therefore, the occurrence of poor ejection in all the energy generating elements can be prevented.

On the other hand, during manufacturing of the liquid ejection head, a connection portion electrically connected to the plurality of protective layers 10 provided above the plurality of energy generating elements 12 is provided. The connection portion is connected to an inspection terminal. By confirming the conduction with the plurality of energy generating elements using the inspection terminal, the insulation of the insulating layer 8 located between the plurality of energy generating elements 12 and the protective layers 10 can be easily confirmed. More specifically, the connection portion is used for electrically connecting each of the plurality of protective layers 10 and an inspection terminal 16. After the completion of such an inspection process, the connection portion is removed to thereby electrically isolate the protective layers 10 for each energy generating element 12.

Even when the energy generating element 12 and one of the protective layers 10 enters a conductive state, an electrochemical reaction does not occur in all the protective layers 10 in a chain reaction manner. Therefore, the occurrence of poor ejection in all the energy generating elements can be prevented.

Manufacturing processes of a method for manufacturing a liquid ejection head of each embodiment of the invention are specifically described below with reference to the drawings.

First Embodiment

Figure 4A:
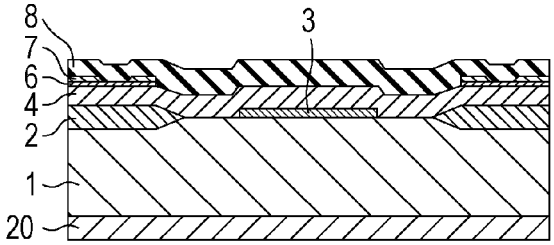
FIGS. 4A to 4F are views explaining a method for manufacturing a liquid ejection head according to a first embodiment.
Figure 4D:
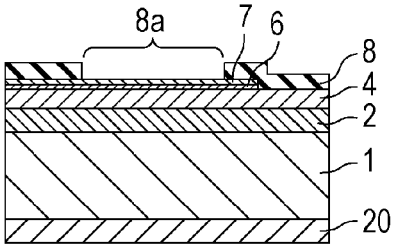
Figure 4B:
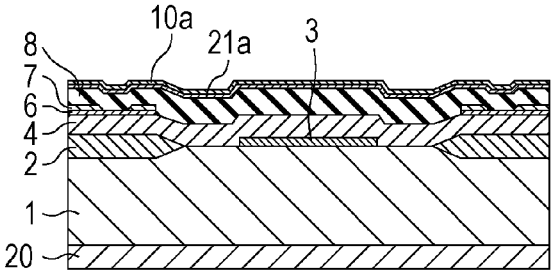
Figure 4E:
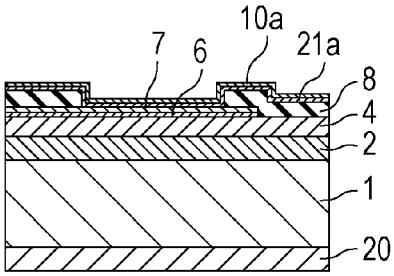
Figure 4C:
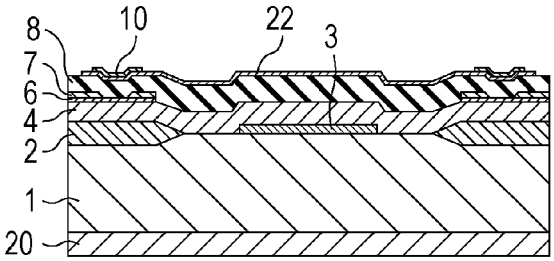
Figure 4F:
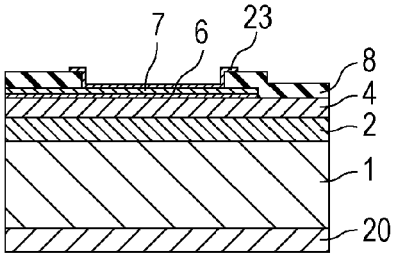
Figure 5A:
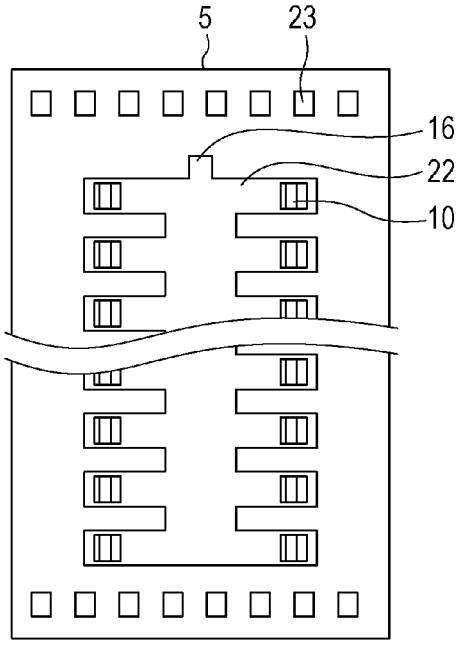
FIGS. 5A to 5C are views explaining the state of confirming an insulating layer of the liquid ejection head according to the first embodiment.
Figure 5B:
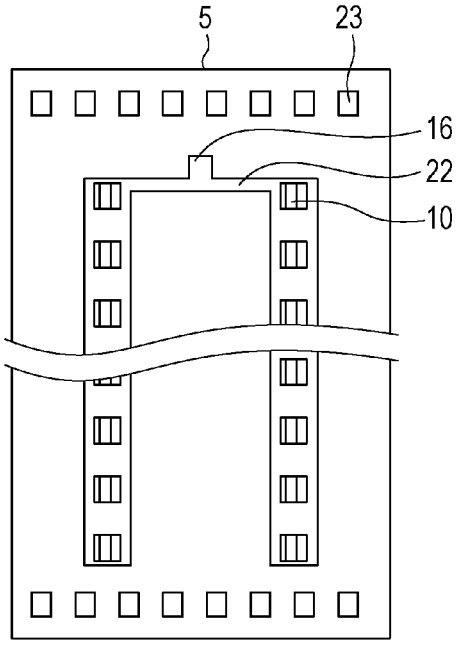
Figure 5C:
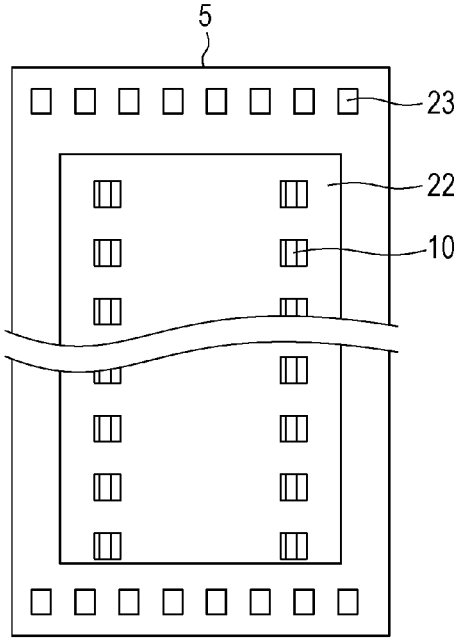

On the left side of FIGS. 4A to 4F and FIGS. 6A to 6F, the state of the cutting plane in each process when the liquid ejection head 41 is cut perpendicularly to the substrate 5 along the A-A' line of FIG. 2A is schematically illustrated. On the right side of FIGS. 4A to 4F and FIGS. 6A to 6F, the state of the cutting plane in each process when a terminal portion of the liquid ejection head 41 is cut perpendicularly to the substrate 5 along the B-B' line of FIG. 2A is schematically illustrated. FIGS. 5A to 5C schematically illustrate the state of the upper surface of the liquid ejection head during inspection of insulation.

First, a base 1 is prepared which contains silicon having the front surface on which a thermal oxidation layer 2 used as a separation layer for driving elements, such as a transistor, is provided and the rear surface on which a thermal oxidation layer 20 used as a mask when providing a supply port 45 is provided. At a portion of the front surface where the supply port 45 is to be opened, a sacrificial layer 3 having a film thickness of about 200 nm to 500 nm is provided using a material that is promptly etched with an etching solution used for opening the supply port 45 and has conductivity. The sacrificial layer 3 can be formed at a portion corresponding to the position of the supply port 45 using, for example, materials containing aluminum as the main component (e.g., Al—Si alloy) or polysilicon by a sputtering method and a dry etching method. On the sacrificial layer 3, a heat storage layer 4 is provided which contains silicon oxide ($SiO_2$) and is formed with a film thickness of about 500 nm to 1 μm using a CVD method or the like.

Next, a material formed into a heat generation resistive layer 6 having a film thickness of about 10 nm to 50 nm and containing TaSiN or WSiN and a conductive layer having a film thickness of about 100 nm to 1 μm serving as a pair of electrodes 7 and containing aluminum as the main component are formed by a sputtering method on the heat storage layer 4. Then, the heat generation resistive layer 6 and the conductive layer are processed using a dry etching method, and further the conductive layer is partially removed by a wet etching method, thereby providing the pair of electrodes 7. The heat generation resistive layer 6 corresponding to the portion where the conductive layer is removed is used as an energy generating element 12. Next, an insulating layer 8 containing silicon nitride (SiN) or the like and having insulation properties with a film thickness of about 100 nm to 1 μm is provided on the entire surface of the substrate using a CVD method or the like in such a manner as to cover the heat generation resistive layer 6 and the pair of electrodes 7. Next, a hole 8*a* is formed by etching the insulating layer 8 after providing a resist mask in a region where a terminal 17 is provided by a photolithographic method. Thus, the states illustrated in FIGS. 4A and 4D are achieved.

Thereafter, a metal layer 21*a* (first metal layer) used as a diffusion preventing layer of plating metal and an close contact layer of a protective layer 10 and the insulating layer 8 is formed with a film thickness of 100 nm to 500 nm on the entire surface of a wafer. Specifically, a metal layer of titanium tungsten (TiW, first metal material) is formed by a sputtering method. Next, a metal layer 10*a* (second metal layer) serving as the protective layer 10 having durability capable of protecting from the cavitation impact or the like associated with foaming and contraction of liquid is formed with a film thickness of 50 nm to 500 nm using a sputtering method. Specifically, a metal material (second metal material), such as tantalum, iridium, ruthenium, chromium, or platinum, can be used (FIGS. 4B and 4E).

Next, a resist pattern is formed only on the energy generating element 12 by a photolithographic method (not illustrated). Then, the metal layer 10*a* is patterned by a dry etching method using gas capable of selectively etching the material of the protective layer 10 to thereby form the protective layer 10.

Next, a resist pattern is formed by a photolithographic method (not illustrated). Then, the metal layer 21*a* is patterned by a dry etching method to thereby form a connection portion 22 (FIGS. 4C and 4F). In this stage, as schematically illustrated in FIGS. 5A to 5C, the patterning is carried out in such a manner that the plurality of protective layers 10 are electrically connected by the connection portion 22. In this stage, as illustrated in FIG. 4F, a diffusion preventing layer 23 which prevents the metal material of a plating layer 30 from diffusing is provided at portions serving as the terminals 17 by patterning the metal layer 21*a*.

Next, a part of the connection portion 22 is used as an inspection terminal 16, an inspection probe or the like is made to abut on the inspection terminal 16 and portions serving as the terminals 17 for driving the plurality of energy generating elements 12, and then a voltage is applied, thereby checking the insulation of the insulating layer 8. Thus, the confirmation of insulation can be performed in a collective manner (inspection process). When it can be confirmed that the inspection terminal 16 and the portions serving as the terminals 17 do not enter a conductive state, it is found that the insulation of the insulating layer 8 is secured. As illustrated in FIG. 5C, the inspection whether the insulation of the insulating layer 8 is secured may be performed by making the inspection probe abut on a certain portion of the connection portion 22 and the portions serving as terminals 17 without providing the inspection terminal 16.

Figure 6A:
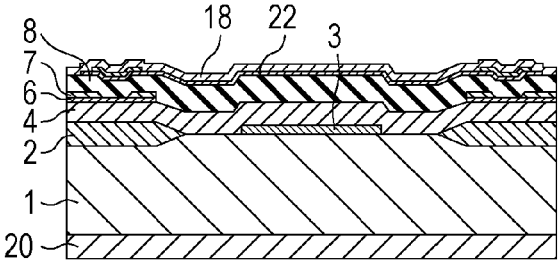
FIGS. 6A to 6F are views explaining the method for manufacturing the liquid ejection head according to the first embodiment.
Figure 6D:
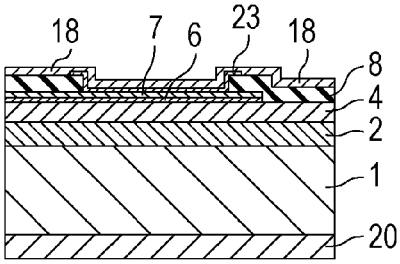

Next, a seed layer 18 for forming the plating layer 30 is provided on the entire surface of a wafer by a sputtering method. As the material of such a seed layer 18, gold (Au) can be used. The seed layer is formed with a film thickness of 50 to 100 nm (FIGS. 6A and 6D).

Figure 6B:
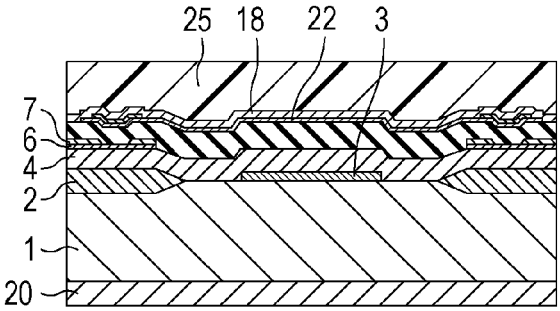
Figure 6E:
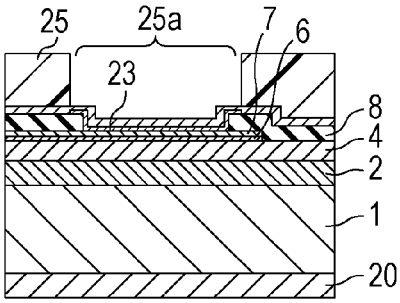

Next, a resist pattern 25 for opening only a pad portion 25*a* is formed by a photolithographic method (FIGS. 6B and 6E).

Then, the seed layer 18 is energized, the plating layer 30 containing gold is formed by an electroplating method to complete the formation of the terminal 17, and then the resist pattern 25 is separated by wet etching.

Figure 6C:
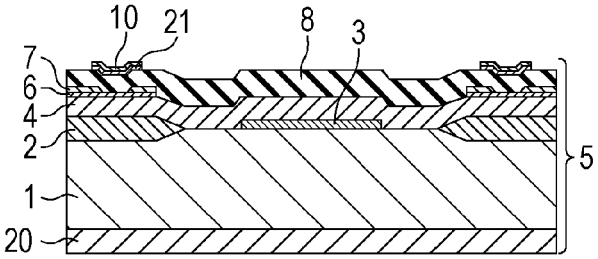
Figure 6F:
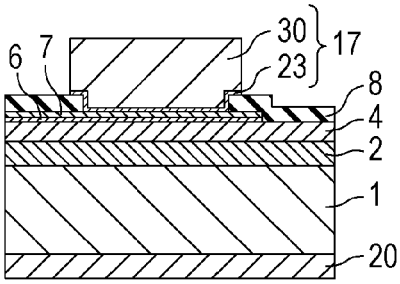

Then, the seed layer 18 formed on the entire surface of the substrate is removed by wet etching with iodine liquid, and further wet etching is performed using a hydrogen peroxide solution with the plating layer 30 and the protective layer 10 as a mask, thereby removing the portion used as the connection portion 22. The protective layers 10 which are electrically conductive to each other through the connection portion 22 are separated by the wet etching using a hydrogen peroxide solution for each energy generating element 12 (FIGS. 6C and 6F). By the patterning of the connection portion 22 then, the close contact layers 21 containing the metal layer 21*a* are formed in such a manner as to be electrically isolated from each other and correspond to the energy generating elements 12 in one-to-one relationship.

In this example, by patterning the metal layer 21*a*, the diffusion preventing layer 23 of the plating layer 30 and the connection portion 22 of the inspection process for confirming insulation by the insulating layer 8 are collectively provided. Thus, it is not necessary to form another metal layer for providing the connection portion 22, which can prevent an increase in manufacturing processes.

Furthermore, when removing the connection portion 22, the use of the plating layer 30 and the protective layer 10 as an etching mask eliminates the necessity of providing another etching mask or the like using a photolithographic method or the like. Thus, an increase in manufacturing process can be prevented.

Second Embodiment

In the first embodiment, a metal layer (second metal layer) serving as the protective layer 10 was formed on the metal layer 21*a* (first metal layer), the connection portion 22 was patterned, and then insulation inspection was performed. This embodiment describes a case where the insulation is inspected by the connection portion 22 containing the metal layer 21*a* (first metal layer), and then the metal layer (second metal layer) of the protective layer 10 is formed.

Figure 7A:
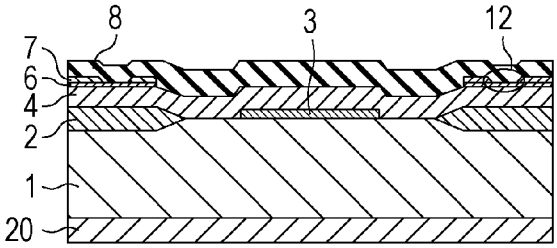
FIGS. 7A to 7F are views explaining a method for manufacturing a liquid ejection head according to a second embodiment.
Figure 7D:
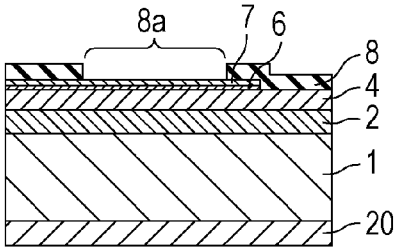
Figure 7B:
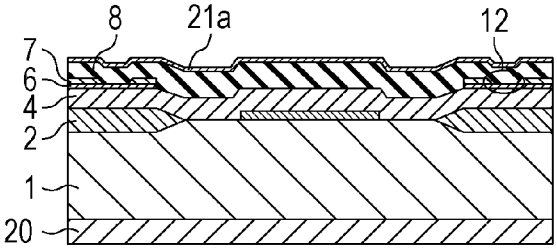
Figure 7E:
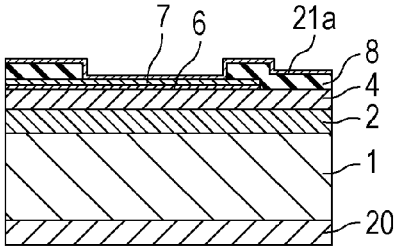
Figure 7C:
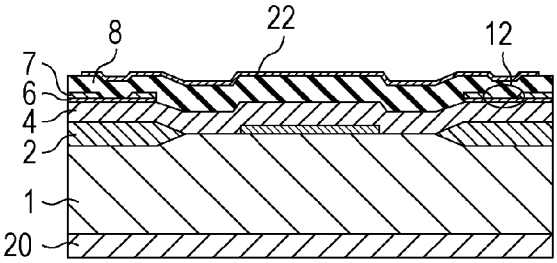
Figure 7F:
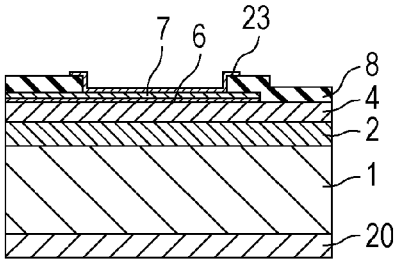
Figure 8A:
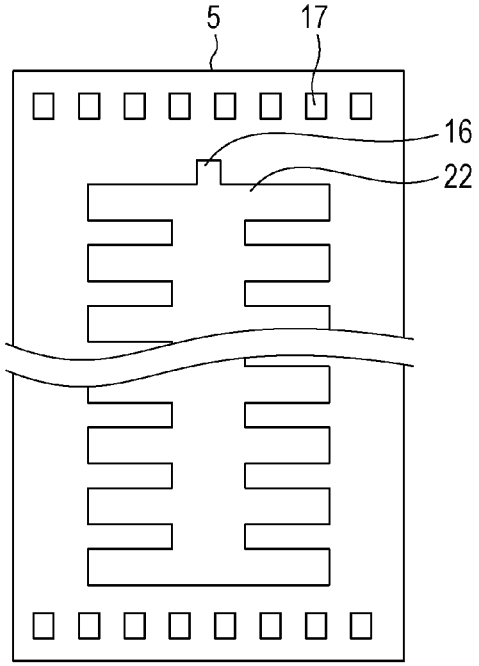
FIGS. 8A to 8C are views explaining the state of confirming an insulating layer of the liquid ejection head according to the second embodiment.
Figure 8B:
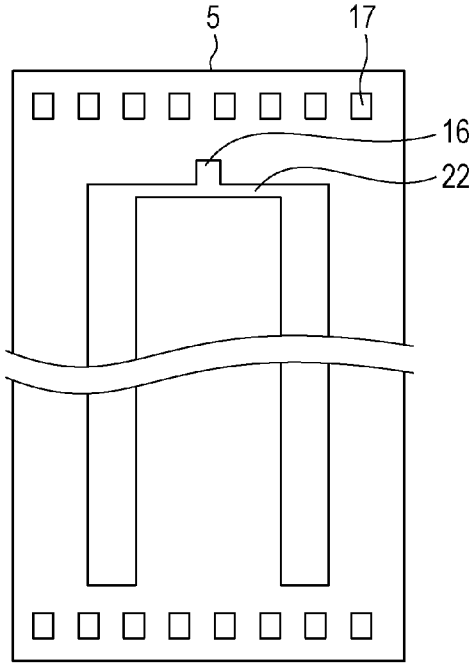
Figure 8C:
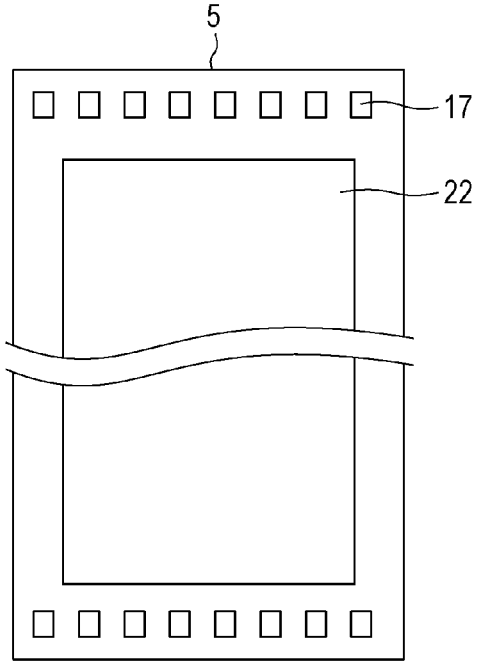

On the left side of FIGS. 7A to 7F and FIGS. 9A to 9H, the state of the cutting plane in each process when the liquid ejection head 41 is cut perpendicularly to the substrate 5 along the A-A' line of FIG. 2A is schematically illustrated. On the right side of FIGS. 7A to 7F and FIGS. 9A to 9H, the state of the cutting plane in each process when a terminal portion of the liquid ejection head 41 is cut perpendicularly to the substrate 5 along the B-B' line of FIG. 2A is schematically illustrated. FIGS. 8A to 8C schematically illustrate the state of the upper surface of the liquid ejection head when inspecting insulation.

First, a base 1 is prepared which contains silicon having the front surface on which a thermal oxidation layer 2 used as a separation layer for driving elements, such as a transistor, is provided and the rear surface on which a thermal oxidation layer 22 used as a mask for providing a supply port 45 is provided. At a portion of the front surface where the supply port 45 is to be opened, a sacrificial layer 3 having a film thickness of about 200 nm to 500 nm is provided using a material that is promptly etched with an etching solution used for opening the supply port 45 and has conductivity. The sacrificial layer 3 can be formed at a portion corresponding to the position of the supply port 45 using, for example, materials containing aluminum as the main component (e.g., Al—Si alloy) or polysilicon by a sputtering method and a dry etching method. On the sacrificial layer 3, a heat storage layer 4 is provided which contains silicon oxide ($SiO_2$) and is formed with a film thickness of about 500 nm to 1 μm using a CVD method or the like.

Next, a material containing TaSiN or WSiN and serving as a heat generation resistive layer 6 having a film thickness of about 10 nm to 50 nm and a conductive layer serving as a pair of electrodes 7, having a film thickness of about 100 nm to 1 μm, and containing aluminum as the main component are formed on the heat storage layer 4 by a sputtering method. Then, the heat generation resistive layer 6 and the conductive layer are processed using a dry etching method, and further the conductive layer is partially removed by a wet etching method, thereby providing the pair of electrodes 7. The heat generation resistive layer 6 corresponding to the portion where the conductive layer is removed is used as an energy generating element 12. Next, an insulating layer 8 containing silicon nitride (SiN) or the like and having insulation properties with a film thickness of about 100 nm to 1 μm is provided on the entire surface of the substrate using a CVD method or the like in such a manner as to cover the heat generation resistive layer 6 or the pair of electrodes 7.

Next, a resist mask is provided in a region where a terminal 17 is provided by a photolithographic method, and then the insulating layer 8 is etched, thereby providing an opening 8*a*. Thus, the state illustrated in FIGS. 7A and 7D is achieved.

Thereafter, a metal layer 21*a* (first metal layer) used as a diffusion preventing layer of plating metal or an close contact layer 21 of a protective layer 10 is formed with a film thickness of 100 nm to 500 nm on the entire surface of a wafer. Specifically, a metal layer of titanium tungsten (TiW) is formed by a sputtering method (FIGS. 7B and 7E).

Next, a resist mask (not illustrated) is formed by a photolithographic method. Then, the metal layer 21*a* is patterned by a dry etching method to thereby form a connection portion 22 as illustrated in FIG. 6B (FIGS. 7C and 7F). In this stage, as schematically illustrated in FIGS. 8A to 8C, the patterning is carried out in such a manner that the plurality of protective layers 10 are electrically connected by the connection portion 22. As illustrated in FIG. 7F, a diffusion preventing layer 23 which prevents the metal material of a plating layer 30 from diffusing is provided at portions serving as the terminals 17 by patterning the metal layer 21*a*.

Next, a part of the connection portion 22 is used as an inspection terminal 16, an inspection probe or the like is made to abut on the inspection terminal 16 and portions serving as the terminals 17 for driving the plurality of energy generating elements 12, and then a voltage is applied, thereby checking the insulation of the insulating layer 8. Thus, the confirmation of insulation by the insulating layer 8 can be performed in a collective manner (inspection process).

When it can be confirmed that the inspection terminal 16 and the portion serving as the terminal 17 are not conductive to each other, it is found that the insulation of the insulating layer 8 is secured. As illustrated in FIG. 8C, the inspection whether the insulation of the insulating layer 8 is secured may be performed by making the inspection probe abut on a certain portion of the connection portion 22 and the portions serving as the terminals 17 without providing the inspection terminal 16.

Next, a metal layer serving as the protective layer 10 having durability capable of protecting from the cavitation impact or the like associated with foaming and contraction of liquid is formed with a film thickness of 50 nm to 500 nm using a sputtering method. Specifically, a metal material, such as tantalum, iridium, ruthenium, chromium, or platinum, can be used.

Figure 9A:
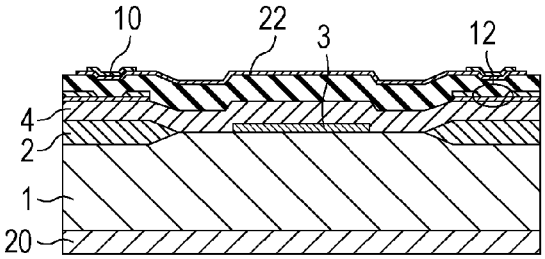
FIGS. 9A to 9H are views explaining the method for manufacturing the liquid ejection head according to the second embodiment.
Figure 9E:
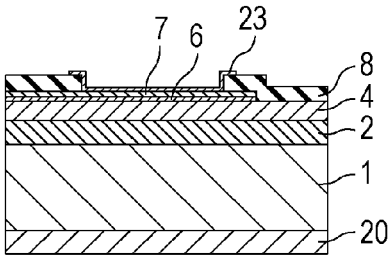

Next, a resist pattern is formed only on the energy generating element 12 by a photolithographic method. Then, the metal layer is etched by a dry etching method using gas capable of selectively etching the material of the protective layer 10 to thereby form the protective layer 10 (FIGS. 9A and 9E).

Figure 9B:
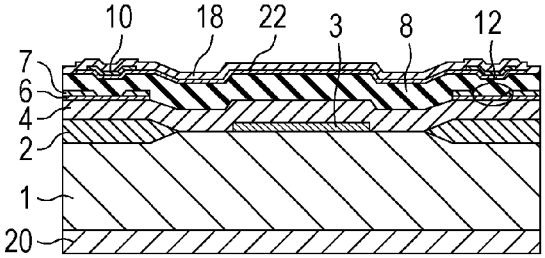
Figure 9F:
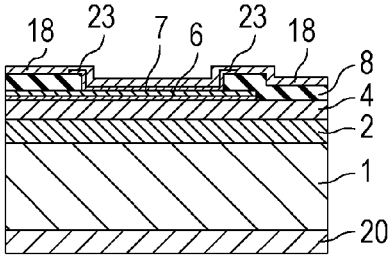

Next, a seed layer 18 when forming the plating layer 30 is provided on the entire surface of a wafer by a sputtering method. As the material of such a seed layer 18, gold (Au) can be used. The seed layer is formed with a film thickness of 50 to 100 nm (FIGS. 9B and 9F).

Figure 9C:
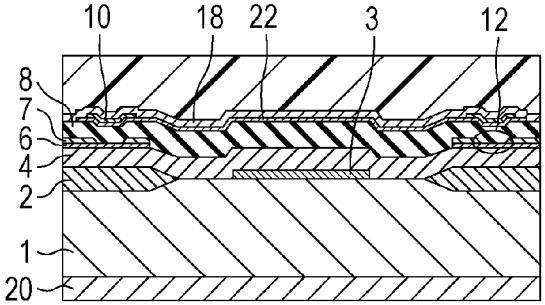
Figure 9G:
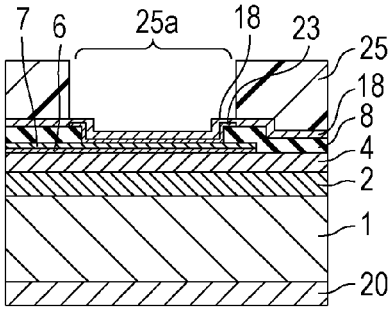

Next, a resist pattern 25 for opening only a pad portion 25*a* is formed by a photolithographic method (FIGS. 9C and 9G).

Then, the seed layer 18 is energized, the plating layer 30 containing gold is formed by an electroplating method to complete the formation of the terminal 17, and then the resist pattern 25 is separated by wet etching.

Figure 9D:
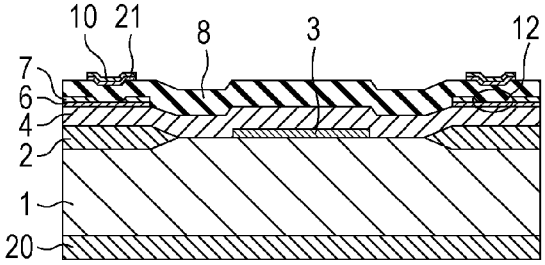
Figure 9H:
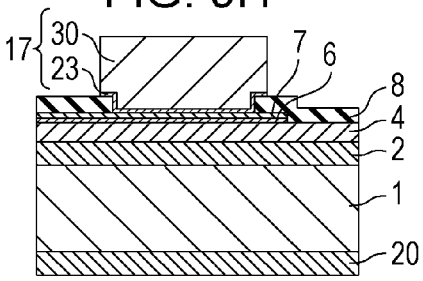

Then, the seed layer 18 formed on the entire surface of the substrate is removed by wet etching with iodine liquid, and further wet etching is performed using a hydrogen peroxide solution with the plating layer 30 and the protective layer 10 as a mask, thereby removing the portion serving as the connection portion 22. The protective layers 10 which are electrically conductive to each other through the connection portion 22 are separated by the wet etching using a hydrogen peroxide solution for each energy generating element 12 (FIGS. 9D and 9H). By the patterning of the connection portion 22, the close contact layers 21 containing the metal layer 21*a* are formed in such a manner as to be electrically isolated from each other and correspond to the energy generating elements 12 in one-to-one relationship.

Third Embodiment

The first embodiment and the second embodiment describe the case where the patterning of the connection portion 22 in which the plurality of protective layers 10 are electrically connected and the patterning of the protective layer 10 are performed at different timings. This embodiment describes a case where the patterning of the connection portion 22 and the patterning of the protective layer 10 are collectively performed. By collectively performing the patterning processes as described in this embodiment, the necessity of providing one process of providing a resist mask by a photolithographic method is eliminated. More specifically, since the processes of formation of a resist, exposure of the resist, patterning of the resist, and separation of the resist for the formation of a resist mask can be reduced, the manufacturing processes can be shortened.

On the left side of FIGS. 10A to 10H and FIGS. 13A to 13F, the state of the cutting plane in each process when the liquid ejection head 41 is cut perpendicularly to the substrate 5 along the A-A' line of FIG. 2A is schematically illustrated. On the right side of FIGS. 10A to 10H and FIGS. 13A to 13F, the state of the cutting plane in each process when a terminal portion of the liquid ejection head 41 is cut perpendicularly to the substrate 5 along the B-B' line of FIG. 2A is schematically illustrated.

First, a base 1 is prepared which contains silicon having the front surface on which a thermal oxidation layer 2 used as a separation layer for driving elements, such as a transistor, is provided and the rear surface on which a thermal oxidation layer 22 used as the mask for providing a supply port 45 is provided. At a portion of the front surface where the supply port 45 is to be opened, a sacrificial layer 3 having a film thickness of about 200 nm to 500 nm is provided using a material that is promptly etched with an etching solution used for opening the supply port 45 and has conductivity. The sacrificial layer 3 can be formed at a portion corresponding to the position of the supply port 45 using, for example, materials containing aluminum as the main component (e.g., Al—Si alloy) or polysilicon by a sputtering method and a dry etching method. On the sacrificial layer 3, a heat storage layer 4 is provided which contains silicon oxide ($SiO_2$) and is formed with a film thickness of about 500 nm to 1 μm using a CVD method or the like.

Figure 10A:
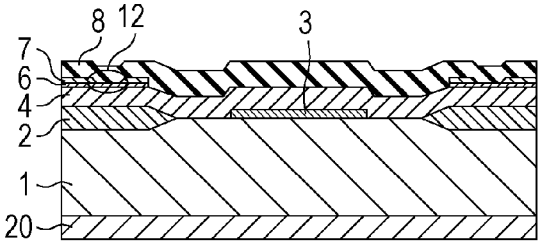
FIGS. 10A to 10H are views explaining a method for manufacturing a liquid ejection head according to a third embodiment.
Figure 10E:
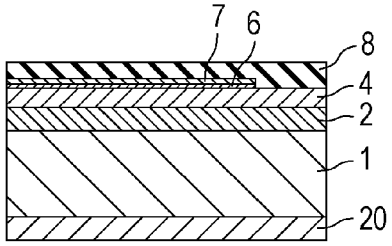

Next, a material containing TaSiN or WSiN and serving a heat generation resistive layer 6 having a film thickness of about 10 nm to 50 nm and a conductive layer serving as a pair of electrodes 7 having a film thickness of about 500 nm to 1 μm and containing aluminum as the main component are formed on the heat storage layer 4 by a sputtering method. Then, the heat generation resistive layer 6 and the conductive layer are processed using a dry etching method, and further the conductive layer is partially removed by a wet etching method, thereby providing the pair of electrodes 7. The heat generation resistive layer 6 corresponding to the portion where the conductive layer is removed is used as the energy generating element 12. Next, an insulating layer 8 containing silicon nitride (SiN) or the like and having insulation properties with a film thickness of about 100 nm to 1 μm is provided on the entire surface of the substrate using a CVD method or the like in such a manner as to cover the heat generation resistive layer 6 or the pair of electrodes 7. Thus, the state illustrated in FIGS. 10A and 10E is achieved.

Figure 10B:
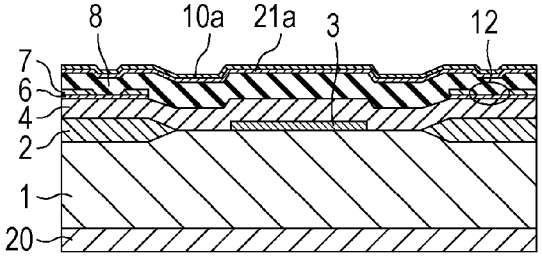
Figure 10F:
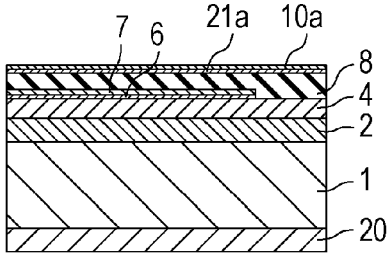

Next, a metal layer 21*a* (first metal layer) used as an close contact layer 21 of the protective layer 10 and the insulating layer 8 is formed by a sputtering method with a film thickness of 50 nm to 100 nm on the entire surface of a wafer. Specifically, a metal layer of titanium tungsten (TiW, first metal material) is formed by a sputtering method. Next, a metal layer (second metal layer) serving as a protective layer 10 having durability capable of protecting from the cavitation impact or the like associated with foaming and contraction of liquid is laminated on the metal layer 21*a* in such a manner as to have a film thickness of 50 nm to 500 nm using a sputtering method. Specifically, a metal material (second metal material), such as tantalum, iridium, ruthenium, chromium, or platinum, can be used. The metal layer 21*a* and the metal film serving as the protective layer 10 are suitably continuously formed (FIGS. 10B and 10F).

Figure 10C:
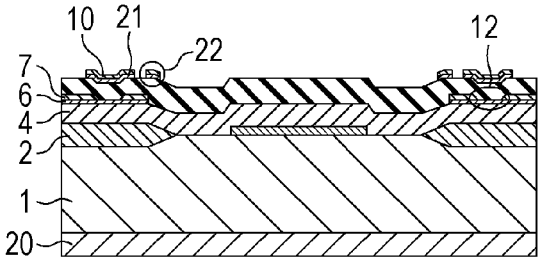
Figure 10G:
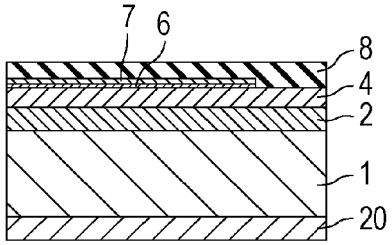
Figure 10D:
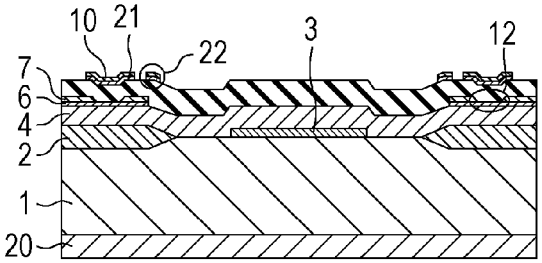

Next, a resist pattern (not illustrated) is formed by a photolithographic method in a region other than the top of the energy generating elements 12 on which the protective layers 10 are formed and the portion serving as a connection portion 22. Furthermore, by performing dry etching with the resist pattern as a mask, the protective layer 10 and the metal layer 21*a* are collectively etched (FIGS. 10C and 10G). The resist pattern in this stage is disposed in such a manner as to be separated from the region serving as the protective layer 10 and the region serving as the connection portion 22. The dry etching method is performed using an ICP etching device. As process gas, a mixed gas of chlorine gas and argon gas is used. With respect to the etching time herein, when the time in which the protective layer 10 and the metal layer 21*a* at a flat portion can be exactly removed is defined as t0, the etching is performed for a period of time 1.10 to 1.20 times t0 (hereinafter which is described as "performing about 10 to 20% over etching").

Figure 11A:
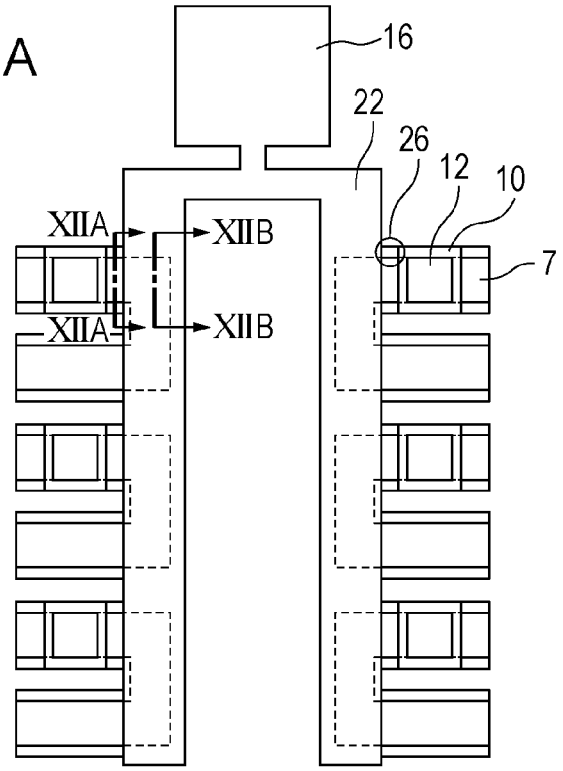
FIGS. 11A and 11B are views explaining the confirmation of insulation of the liquid ejection head according to the third embodiment.

FIG. 11A schematically illustrates the state of the upper surface of the liquid ejection head when each of the protective layers 10 and the connection portion 22 are electrically connected through conduction portions 26 when inspecting insulation.

Figure 12A:
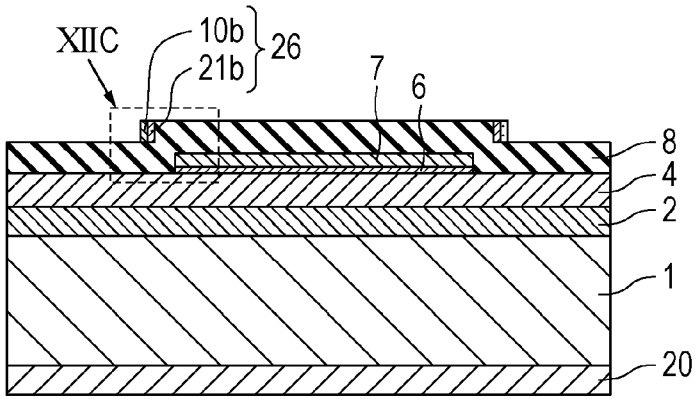
FIGS. 12A to 12C are views explaining a connection portion of the liquid ejection head according to the third embodiment.

The state of the cutting plane of the liquid ejection head at this time is described with reference to FIGS. 12A to 12C. FIG. 12A schematically illustrates the state of the cutting plane when the liquid ejection head 41 is cut perpendicularly to the substrate 5 along XIIA-XIIA line of FIG. 11A. FIG. 12C illustrates an enlarged view of the XIIC portion of FIG. 12A.

By performing about 10 to 20% over etching, the protective layer 10 and the metal layer 21*a* at the flat portion are completely removed as illustrated in FIG. 12C. However, at a level difference portion of the insulating layer 8 corresponding to a level difference portion of the pair of electrodes 7, the film thickness of the metal film 21*a* and the metal film serving as the protective layer 10 becomes large or the etching rate becomes low. Therefore, an etching residue is generated by the about 10 to 20% over etching. Thus, the conduction portion 26 containing an etching residue portion 10*b* of the protective layer 10 and an etching residue portion 21*b* of the metal layer 21*a* is formed.

Figure 12B:
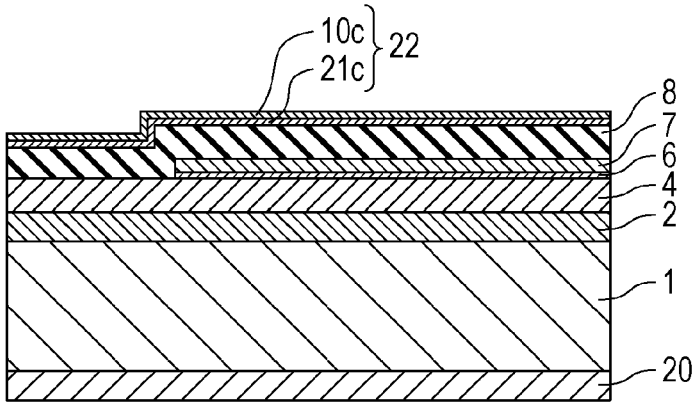
Figure 12C:
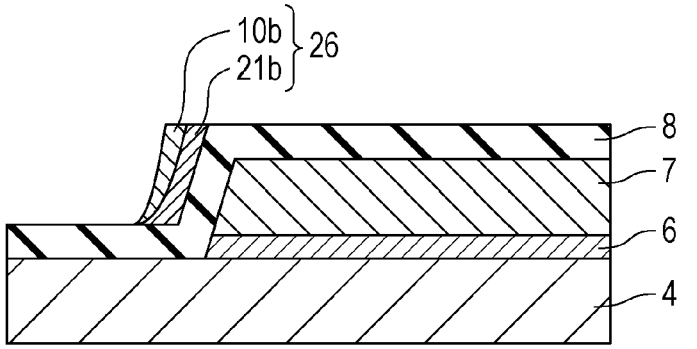

On the other hand, FIG. 12B schematically illustrates the state of the cutting plane when the connection portion 22 of the liquid ejection head 41 is cut perpendicularly to the substrate 5 along XIIB-XIIB line of FIG. 11A. Herein, since neither the level difference portion of the insulating layer 8 nor the flat portion thereof is etched, the connection portion 22 is formed by a conductive layer 21*c* and a conductive layer 10*c*.

Figure 10H:
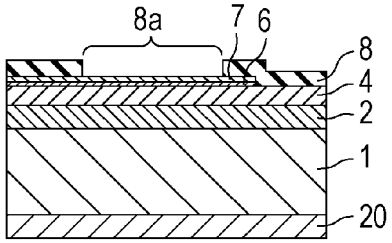

Next, a resist mask is provided in a region where a terminal 17 is provided by a photolithographic method, and then the insulating layer 8 is etched, thereby providing an opening 8*a* (FIG. 10H).

Next, similarly as in the first embodiment and the second embodiment, an inspection probe terminal is made to abut on an inspection terminal 16 illustrated in FIG. 11A and portions serving as the terminals 17 for driving the plurality of energy generating elements 12, and then a voltage is applied, thereby checking the insulation of the insulating layer 8. Thus, the confirmation of insulation can be performed in a collective manner (inspection process). When it can be confirmed that the inspection terminal 16 and the portions serving as the terminals 17 are not conductive to each other, it is found that the insulation of the insulating layer 8 is secured.

Figure 13A:
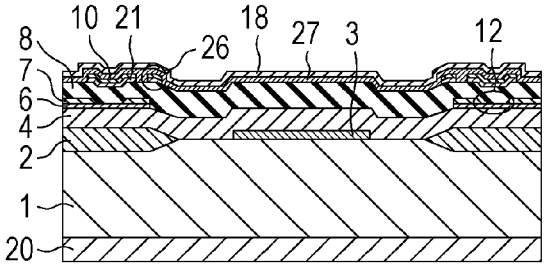
FIGS. 13A to 13F are views explaining the method for manufacturing the liquid ejection head according to the third embodiment.
Figure 13D:
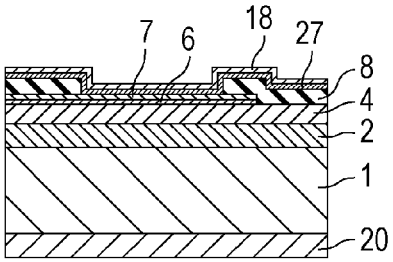
Figure 14A:
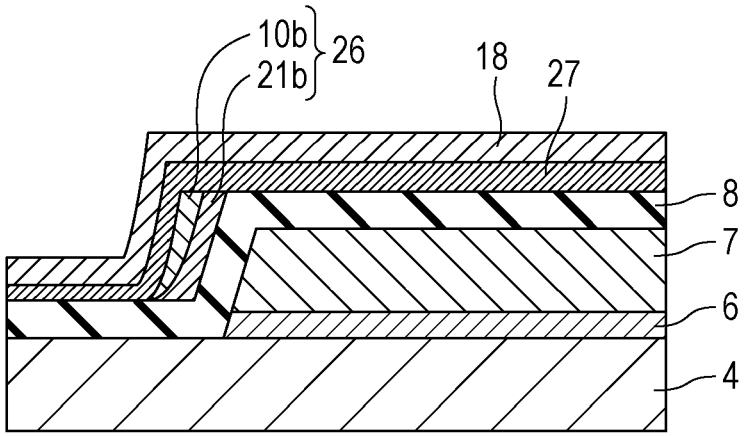
FIGS. 14A and 14B are views explaining the removal of the connection portion of the liquid ejection head according to the third embodiment.

Next, a metal layer 27 used as a gold plating layer 30 and a diffusion preventing layer 23 and a seed layer 18 are formed on the entire surface of a wafer by a sputtering method. Specifically, the metal layer 27 is obtained by forming titanium tungsten (TiW) with a thickness of 100 nm to 200 nm, and then forming gold (Au) with a film thickness of 50 nm to 100 nm (FIGS. 13A and 13D). A portion XIIC of FIG. 12 in this stage is as illustrated in FIG. 14A.

Figure 13B:
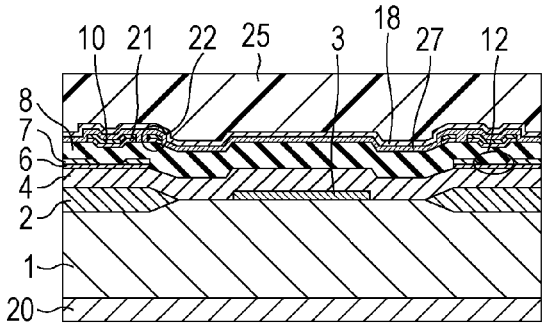
Figure 13E:
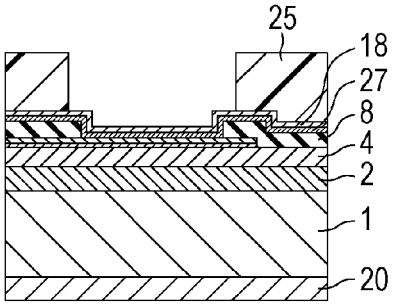

Next, a resist pattern 25 for opening only a pad portion 25*a* is formed by a photolithographic method (FIGS. 13B and 13E).

Then, the seed layer 18 is energized, the plating layer 30 containing gold is formed by an electroplating method to complete the formation of the terminal 17, and then the resist pattern 25 is separated by wet etching.

Figure 13C:
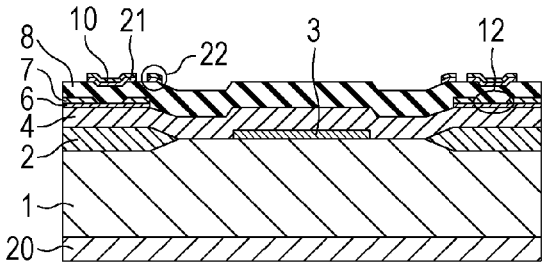
Figure 13F:
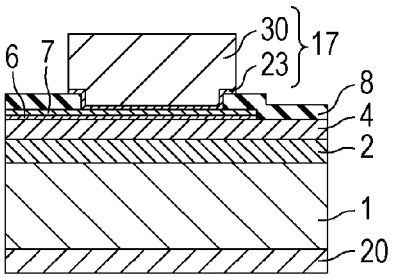

Thereafter, the seed layer 18 formed on the outermost surface of the substrate is removed by wet etching with iodine liquid, and then wet etching is performed using a hydrogen peroxide solution with the plating layer 30 and the protective layer 10 as a mask, thereby removing the metal layer 27 and the conduction portion 26 (FIGS. 13C and 13F).

In this stage, the metal layer 27 formed with titanium tungsten and the etching residue portion 21*b* of the metal of the conduction portion 26 are removed by dissolving with a hydrogen peroxide solution. On the other hand, the etching residue portion 10*b* formed with metal materials, such as tantalum, iridium, ruthenium, chromium, or platinum, of the conduction portion 26 is not removed by the dissolution by a hydrogen peroxide solution but are removed by separation (lift off) associated with the removal of an etching residue portion 21 at the lower portion.

Figure 11B:
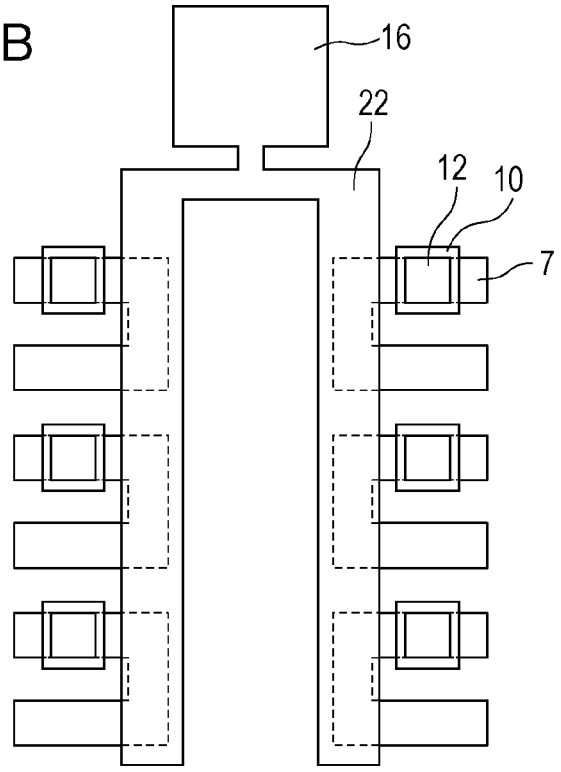
Figure 14B:
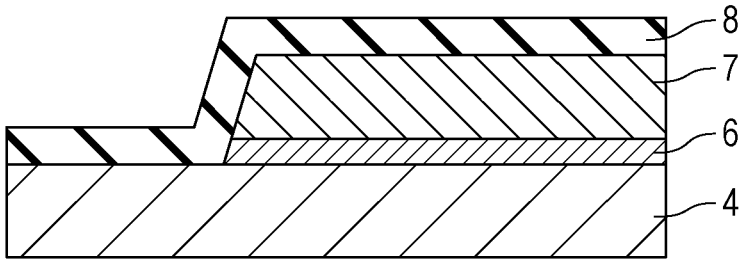

The wet etching by a hydrogen peroxide solution is performed for a period of time twice the time in which the flat portion of the metal layer 27 is exactly removed, i.e., 100% over etching. By setting the over etching to 100% over etching, the metal layer 27 and the conduction portion 26 at the side wall of the level difference portion of the insulating layer 8 are certainly removed as illustrated in FIG. 11B and FIG. 14B. Therefore, the protective layers 10 are completely electrically isolated.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-038859 filed Feb. 24, 2012, which is hereby incorporated by reference herein in its entirety.

What is claimed is:

1. A method for manufacturing a liquid ejection head having a plurality of thermal energy generating elements which generate thermal energy to be utilized for ejecting liquid, an insulating layer covering the plurality of energy generating elements, a plurality of first portions provided on the insulating layer corresponding to the plurality of energy generating elements in one-to-one relationship, and a plurality of second portions provided on the plurality of the first portions in one-to-one relationship, comprising the following steps in the following order:

preparing a base on which the plurality of thermal energy generating elements and the insulating layer are laminated in this order;

forming a first metal layer containing a first metal material on the insulating layer of the base;

forming a second metal layer containing a second metal material on the first metal layer, and then patterning the second metal layer to form the plurality of second portions containing the second metal material;

patterning the first metal layer to thereby form the plurality of first portions and a connection portion for electrically connecting the plurality of first portions from the first metal layer;

inspecting conduction of the plurality of first portions through the connection portion; and patterning the connection portion to thereby electrically isolate the plurality of first portions from each other.

2. The method for manufacturing the liquid ejection head according to claim 1, wherein the first metal material contains titanium tungsten.

3. The method for manufacturing the liquid ejection head according to claim 1, wherein the second metal material contains any one of tantalum, platinum, iridium, and ruthenium.

4. The method for manufacturing the liquid ejection head according to claim 1, wherein the connection portion is patterned with the plurality of second portions as a mask.

5. The method for manufacturing the liquid ejection head according to claim 1, wherein the liquid ejection head contains a terminal containing a third metal material and electrically connecting the plurality of energy generating elements and the outside and a diffusion preventing layer contacting the terminal and provided on a side of the base, and in the formation of the connection portion, the first metal layer is patterned to form the connection portion and form the diffusion preventing layer containing the first metal material.

6. The method for manufacturing the liquid ejection head according to claim 5, wherein the first metal material contains titanium tungsten.

7. The method for manufacturing the liquid ejection head according to claim 5, wherein the third metal material contains gold.

8. A method for manufacturing a liquid ejection head having a plurality of thermal energy generating elements which generate thermal energy to be utilized for ejecting liquid, an insulating layer covering the plurality of energy generating elements, a plurality of first portions provided on the insulating layer corresponding to the plurality of energy generating elements in one-to-one relationship, and a plurality of second portions provided on the plurality of the first portions in one-to-one relationship, comprising the following steps in the following order:

preparing a base on which the plurality of thermal energy generating elements and the insulating layer are laminated in this order;

forming a first metal layer containing a first metal material on the insulating layer of the base, and then patterning the first metal layer to thereby form the plurality of first portions and a connection portion for electrically connecting the plurality of the first portions from the first metal layer;

inspecting conduction of the plurality of first portions through the connection portion;

forming a second metal layer containing a second metal material on the first metal layer, and then patterning the second metal layer to form the plurality of second portions; and patterning the connection portion to thereby electrically isolate the plurality of first portions from each other.

9. The method for manufacturing the liquid ejection head according to claim 8, wherein the first metal material contains titanium tungsten.

10. The method for manufacturing the liquid ejection head according to claim 8, wherein the second metal material contains any one of tantalum, platinum, iridium, and ruthenium.

11. A method for manufacturing a liquid ejection head having a plurality of thermal energy generating elements which generate thermal energy to be utilized for ejecting liquid, an insulating layer covering the plurality of energy generating elements, a plurality of first portions provided on the insulating layer corresponding to the plurality of energy generating elements in one-to-one relationship, and a plurality of second portions provided on the plurality of the first portions in one-to-one relationship, comprising the following steps in the following order:

preparing a base on which the plurality of thermal energy generating elements and the insulating layer are laminated in this order;

forming a first metal layer containing a first metal material on the insulating layer of the base;

forming a second metal layer containing a second metal material on the first metal layer;

collectively patterning the first metal layer and the second metal layer to form the plurality of first portions, the plurality of second portions, and a connection portion containing the first metal material and electrically connecting the plurality of first portions;

inspecting conduction of the plurality of first portions through the connection portion; and patterning the connection portion to thereby electrically isolate the plurality of first portions from each other.

12. The method for manufacturing the liquid ejection head according to claim 11, wherein the first metal material contains titanium tungsten.

13. The method for manufacturing the liquid ejection head according to claim 11, wherein the second metal material contains any one of tantalum, platinum, iridium, and ruthenium.

* * * * *